US009435594B2

(12) United States Patent
Davison et al.

(10) Patent No.: US 9,435,594 B2
(45) Date of Patent: Sep. 6, 2016

(54) LOW AMMUNITION WARNING SWITCH

(71) Applicant: Contract Fabrication and Design, Princeton, TX (US)

(72) Inventors: Jesse L. Davison, McKinney, TX (US); M. Damon Serkland, Lavon, TX (US); Jarrett O'Hara, Plano, TX (US); Marvin Vale Riggall, Jr., Nevada, TX (US)

(73) Assignee: Contract Fabrication & Design, LLC, Princeton, TX (US)

( * ) Notice: Subject to any disclaimer, the term of this patent is extended or adjusted under 35 U.S.C. 154(b) by 0 days.

(21) Appl. No.: 14/856,838

(22) Filed: Sep. 17, 2015

(65) Prior Publication Data

US 2016/0076839 A1 Mar. 17, 2016

Related U.S. Application Data

(60) Provisional application No. 62/051,680, filed on Sep. 17, 2014.

(51) Int. Cl.
*F42B 39/00* (2006.01)
*F41A 9/62* (2006.01)

(52) U.S. Cl.
CPC ..... *F41A 9/62* (2013.01)

(58) Field of Classification Search
CPC ..... F41A 9/62
See application file for complete search history.

(56) References Cited

U.S. PATENT DOCUMENTS

| | | | | | |
|---|---|---|---|---|---|
| 2,303,479 | A * | 12/1942 | Lesnick | F41A 9/62 | 235/144 E |
| 2,382,715 | A * | 8/1945 | Hertel | F41A 9/81 | 193/25 AC |
| 2,710,561 | A * | 6/1955 | Dowd | F41A 9/79 | 206/3 |
| 3,762,268 | A * | 10/1973 | Gaye | F41A 9/80 | 42/1.02 |
| 4,299,158 | A * | 11/1981 | Aloi | F41A 9/81 | 42/1.01 |
| 4,506,588 | A * | 3/1985 | Kazanjy | F41A 9/82 | 89/33.25 |
| 5,782,157 | A * | 7/1998 | Ellington | F41A 9/29 | 193/25 AC |
| 2006/0053671 | A1* | 3/2006 | Weinberger | F41A 9/65 | 42/1.01 |
| 2011/0030257 | A1* | 2/2011 | Gwillim, Jr. | F41A 9/62 | 42/1.02 |
| 2016/0061545 | A1* | 3/2016 | Chachamian | F41A 9/34 | 89/33.2 |

* cited by examiner

*Primary Examiner* — Gabriel Klein
(74) *Attorney, Agent, or Firm* — Harness Dickey & Pierce PLC; Robert C. Klinger

(57) ABSTRACT

An ammunition magazine, including a container configured to hold ammunition and dispense the ammunition to a weapon, and an indicator disposed in the container and configured to create a signal indicative of a predetermined amount of ammunition remains in the container. In one example embodiment, the indicator includes a sensor member configured to engage with the ammunition when more than the predetermined amount of ammunition remains in the container, and configured to not engage with the ammunition when less than the predetermined amount of ammunition remains in the container. A signal generator is coupled to the sensor member and configured to provide an electrical signal indicative of whether the sensor member is engaging the ammunition, or is not engaging the ammunition.

19 Claims, 6 Drawing Sheets

LOW AMMUNITION WARNING SWITCH

CLAIM OF PRIORITY

This application claims priority under 35 U.S.C. Section 119(e) of U.S. Provisional Patent Application Ser. No. 62/051,680 titled Low Ammunition Warning Switch filed Sep. 17, 2014, the teachings of which are included herein in its entirely.

BACKGROUND OF THE DISCLOSURE

Generally, ammunition (ammo) magazines for weapons, such as guns, do not have a low ammunition indicator. The user will simply open a magazine lid and check the ammo level, or there will be a viewing window in the lid that lets the user see how much is remaining.

Ammunition magazines are used in harsh and moving environments. Ammunition can easily shift inside the magazine as a turret moves and rotates in several combinations of movements. In addition, there are remote turret applications where a user does not have access to check the ammo level. Reliable magazines are required in such environments.

SUMMARY

An ammunition magazine, including a container configured to hold ammunition and dispense the ammunition to a weapon, and an indicator disposed in the container and configured to create a signal indicative of a predetermined amount of ammunition remains in the container. In one example embodiment, the indicator comprises a sensor member configured to engage with the ammunition when a predetermined amount of the ammunition remains in the container, and configured to not engage with the ammunition when less than the predetermined amount of ammunition remains in the container. An electrical device is coupled to the sensor member and configured to provide an electrical signal indicative of whether the sensor member is engaging the ammunition, or is not engaging the ammunition.

The low ammo switch is reliable and simple. In one embodiment of the disclosure, the ammo is loaded under a ledge and draped over the vertical members so that minimal shifting will occur as the magazine moves.

DETAILED DESCRIPTION

Figure 1:
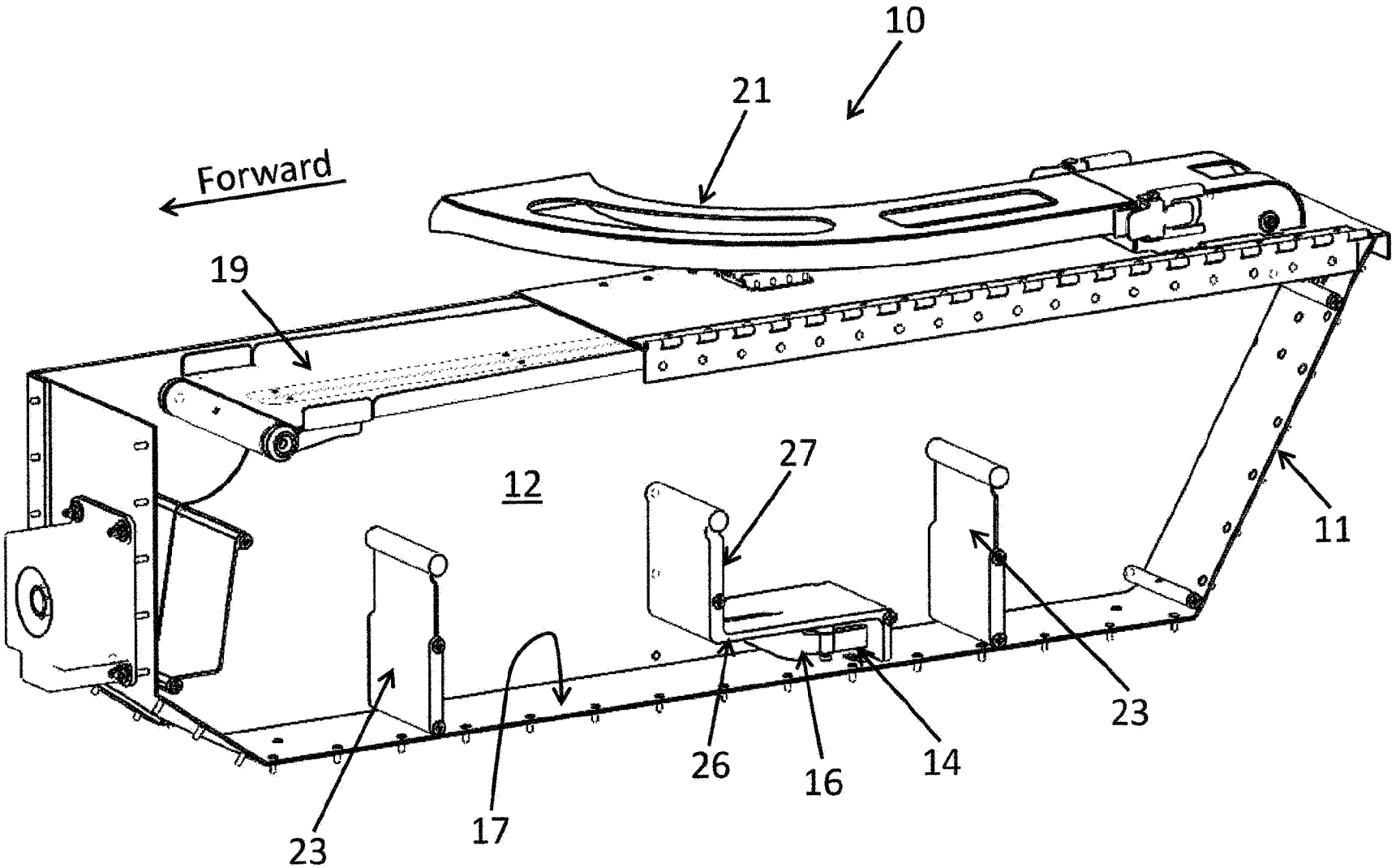
FIG. 1 illustrates a cross sectional view of an ammunition magazine having a low ammunition warning switch.

FIG. 1 illustrates a cross sectional view of an ammunition magazine 10 suitable for a weapon (not shown) according to an example embodiment of this disclosure. The magazine 10 has a container 11 having a compartment 12 configured to hold ammunition 30 (see FIG. 3) suitable for the weapon. The magazine 10 has a low ammunition switch 14 positioned at the bottom of the compartment 12, such as at a central location. The switch 14 is configured to toggle states when the ammunition 30 remaining in the compartment 12 is below a predetermined amount, enabling a user to be aware of the low ammunition situation. The predetermined amount is a function of several variables, such as where the switch 14 is positioned, the size of the ammunition, the size of the compartment 12, just to name a few.

As will be described in more detail shortly with reference to an example embodiment, the switch 14 has a spring tension flapper 16 positioned under a ledge 26 that is parallel to a bottom 17 of the compartment 12. When ammunition 30 is no longer engaged against the spring tension flapper 16, the switch 14 provides an electrical signal that indicates that the supply of ammunition is low and below a predetermined amount. When the ammunition 30 is engaged against the spring tension flapper 16, the switch 14 sends a different signal, or no signal at all. In one embodiment, the release of the flapper 16 causes the switch 14 to open, such that a monitoring circuit coupled to the switch (not shown) and accessible by the user responsively indicates a low ammunition condition. In other embodiments, the switch 14 may be configured to close when ammunition is no longer engaged against the spring tension flapper 16.

FIG. 1 also shows an ammunition tray 19 configured to draw the ammunition 30 from the compartment 12, and a feed chute 21 configured to route the ammunition to the weapon, as is conventional in ammunition loaders. A pair of vertical members 23 are positioned each side of switch 14, and are configured to prevent the ammunition from shifting during movement of the magazine 10.

Figure 2:
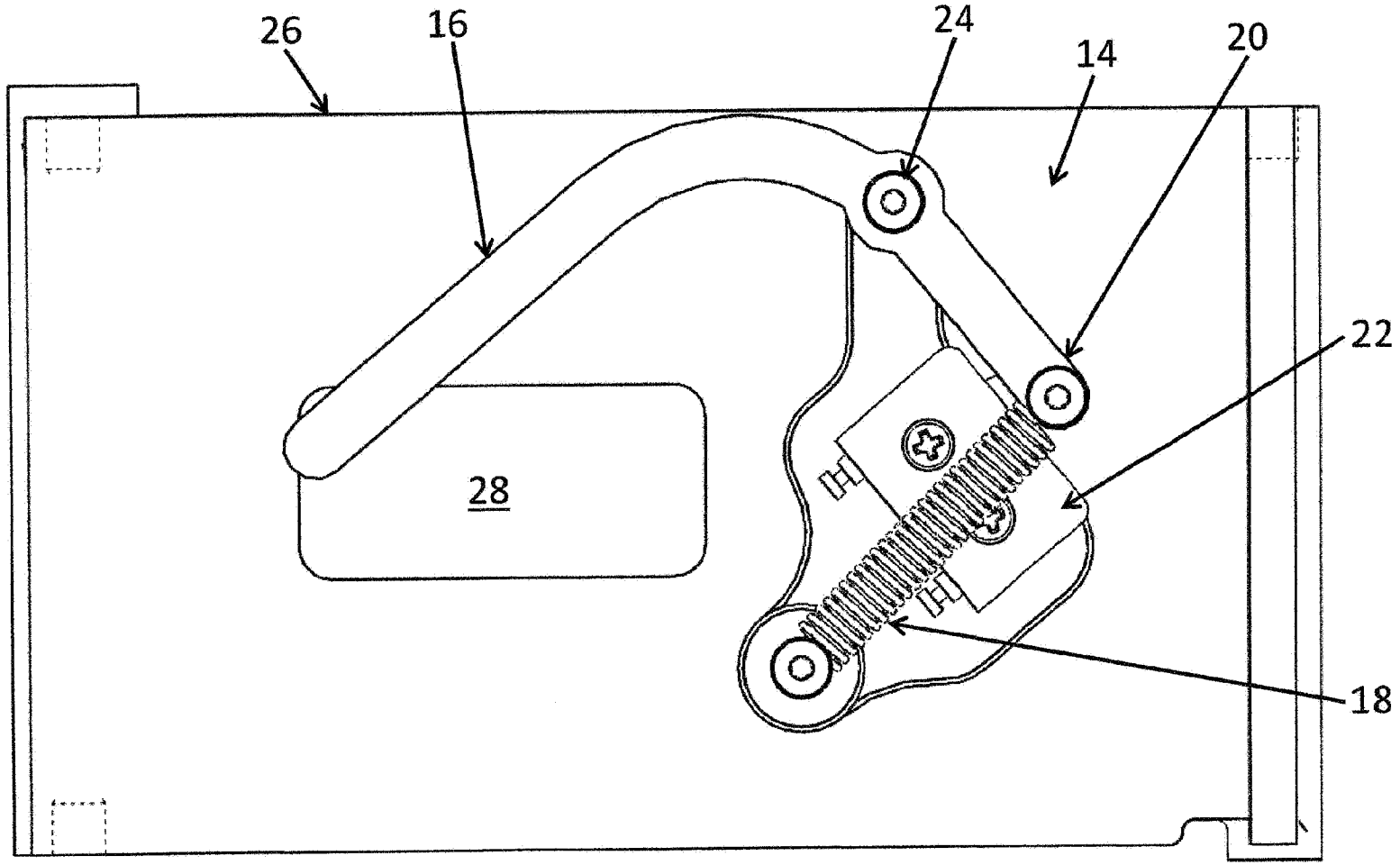
FIG. 2 illustrates the switch with a flapper in a free position, with a spring retracted such that a proximal end of flapper engages a micro switch element such that it is open, indicating that the supply of ammunition in the magazine is below a predetermined quantity and indicative of low ammunition in the ammunition magazine.

FIG. 2 illustrates a low ammunition configuration, with the flapper 16 in a free extended position, and a spring 18 retracted such that a proximal end 20 of flapper 16 engages a movable element of micro switch 22 such that the micro switch 22 is open. The flapper 16 is pivotably connected at pivot 24 to an underside of the ledge member 26, and is pivotable in a direction parallel to the compartment bottom 17 and the ledge 26. The spring 18 is connected to the proximal end 20 of flapper 16 at one end and to the underside of ledge member 26 at the other end. The ledge member 26 has a window 28 comprising a slot permitting a user to view from above whether ammunition 30 is engaging the flapper 16, or not.

Figure 3:
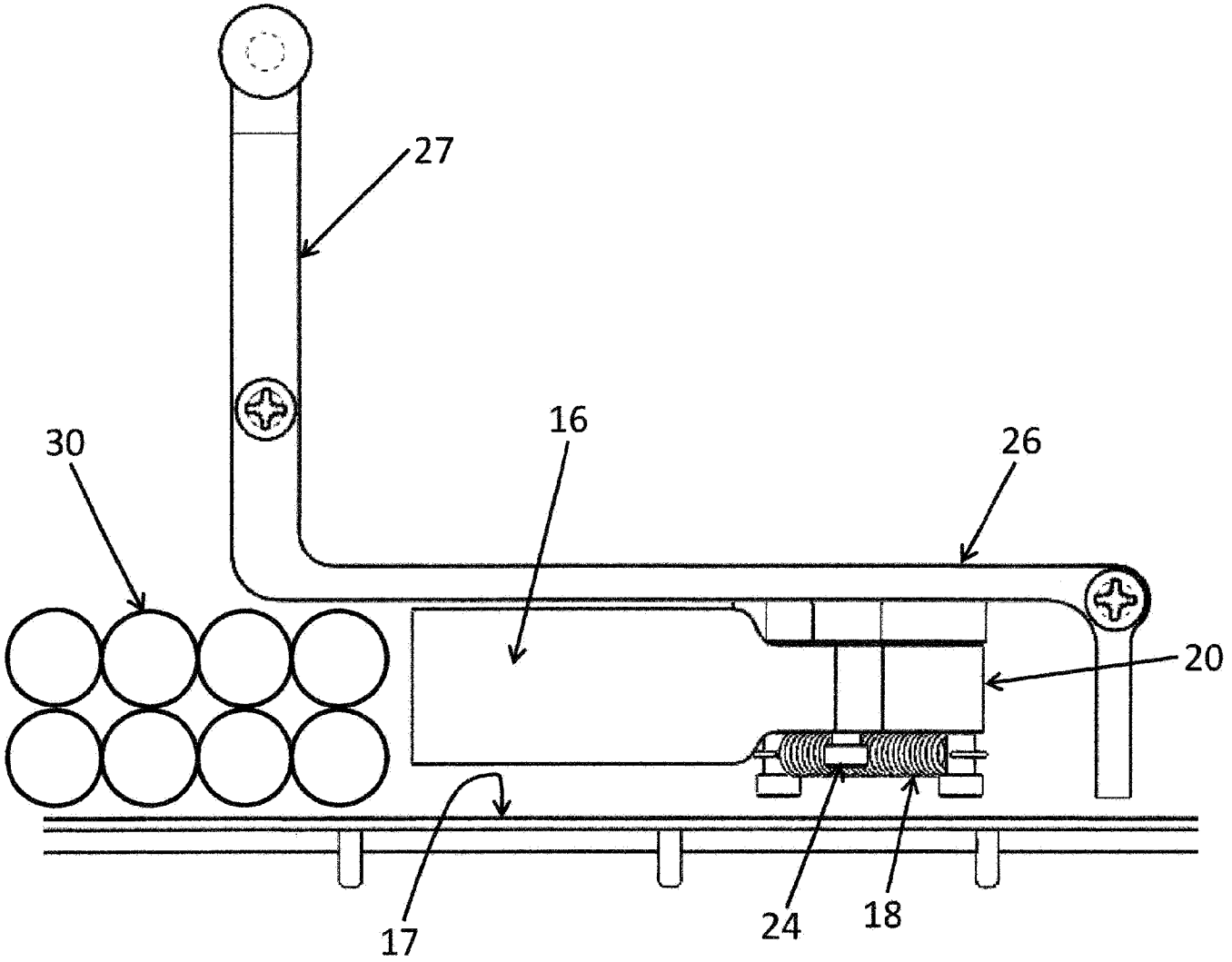
FIG. 3 illustrates the low ammunition configuration where the ammunition does not engage the flapper, and the switch is open as shown in FIG. 2.

FIG. 3 illustrates a side sectional view of the low ammunition configuration where the ammunition 30 does not engage the flapper 16, and the micro switch 22 is open as shown in FIG. 2. As ammunition 30 is pulled from the magazine 10, when a predetermined amount of ammunition 30 is left in the compartment 12, the flapper 16 becomes free and the micro switch opens. The predetermined amount depends on the location of the switch 14 in the compartment 12, the ammunition loading pattern, the size of the ammunition and the compartment 12, just to name a few parameters. The ledge member 26 is seen to have a vertical member 27 extending from an edge proximate the feed area of the ammunition to the flapper 16. In this embodiment, the ledge member 26 is configured and located so that two rows of ammunition 30 are wedged underneath it during loading. The vertical members 27 and 23 are located so that the ammunition 30 is draped over them and stays wedged underneath the ledge member 26 as the magazine 10 moves until the gun pulls the ammunition from under the ledge member 26. In other embodiments, the ledge member 26 can have other dimensions suited to wedge more or less rows of ammunition 30 thereunder.

In one example embodiment, the magazine 10 and ammunition 30 may be suitable for a M240 gun, and the micro switch 22 opens when there is about 215 rounds remaining in the magazine 10. When more ammunition than the predetermined amount remains, the micro switch 22 is closed. The switch 14 can be located and configured such that more or less ammunition 30 may remain in the magazine 10 when the micro switch 22 opens, and the magazine 10 and ammunition 30 may be suitable for other weapons.

Figure 4:
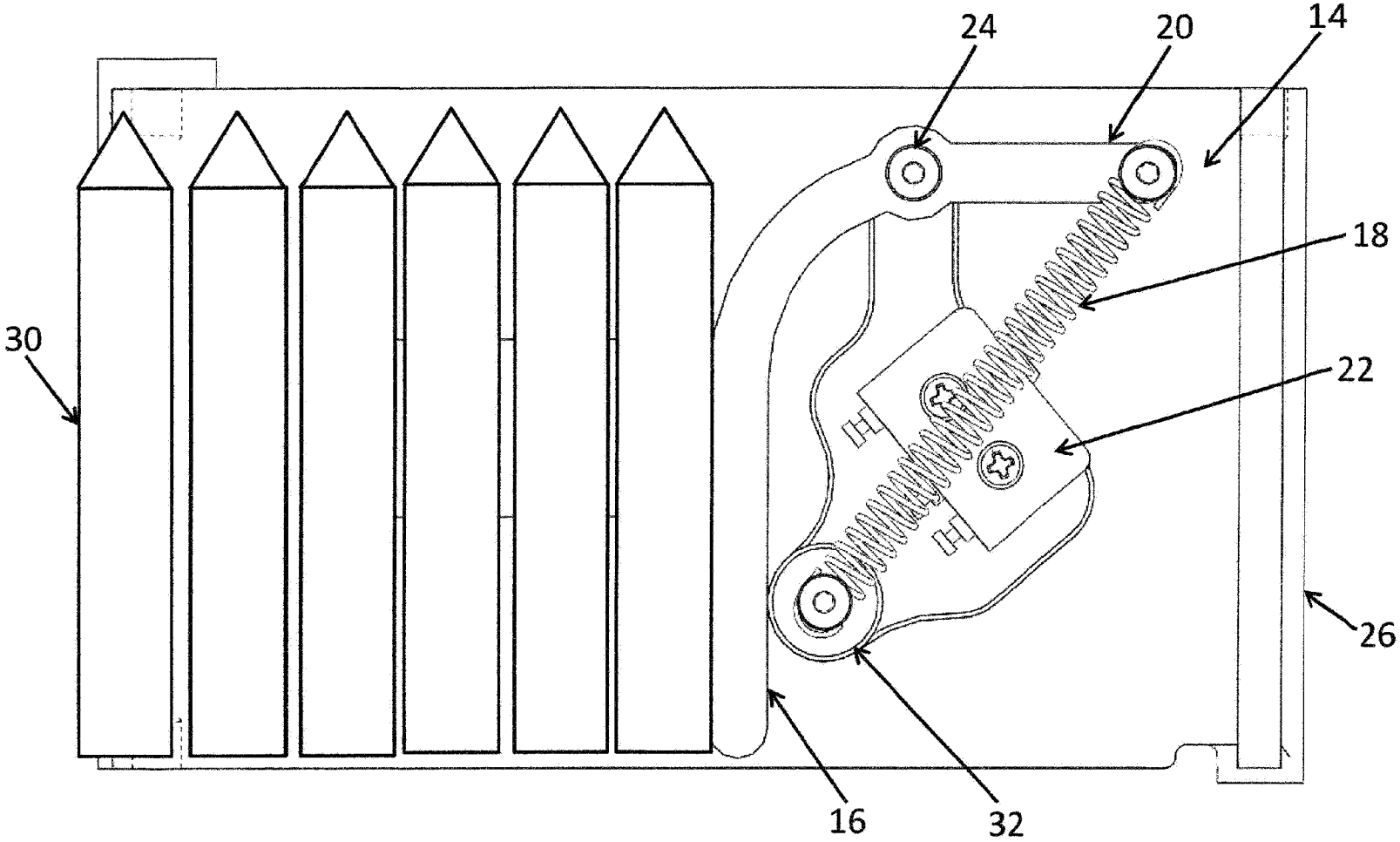
FIG. 4 illustrates the switch in the closed position, with the ammunition engaged with the flapper and compressing it against a hard stop member, indicating the supply of ammunition is greater than a predetermined quantity.

FIG. 4 illustrates the micro switch 22 in the closed position, with the ammunition 30 is engaged with a distal end of the flapper 16 and compressing it against a hard stop member 32. The spring 18 is extended, and the proximal end 20 of the flapper 16 is separated from micro switch 22 such that it is closed. The micro switch 22 thus generates a signal indicative that the amount of ammunition remaining in compartment 12 is more than the predetermined amount.

Figure 5:
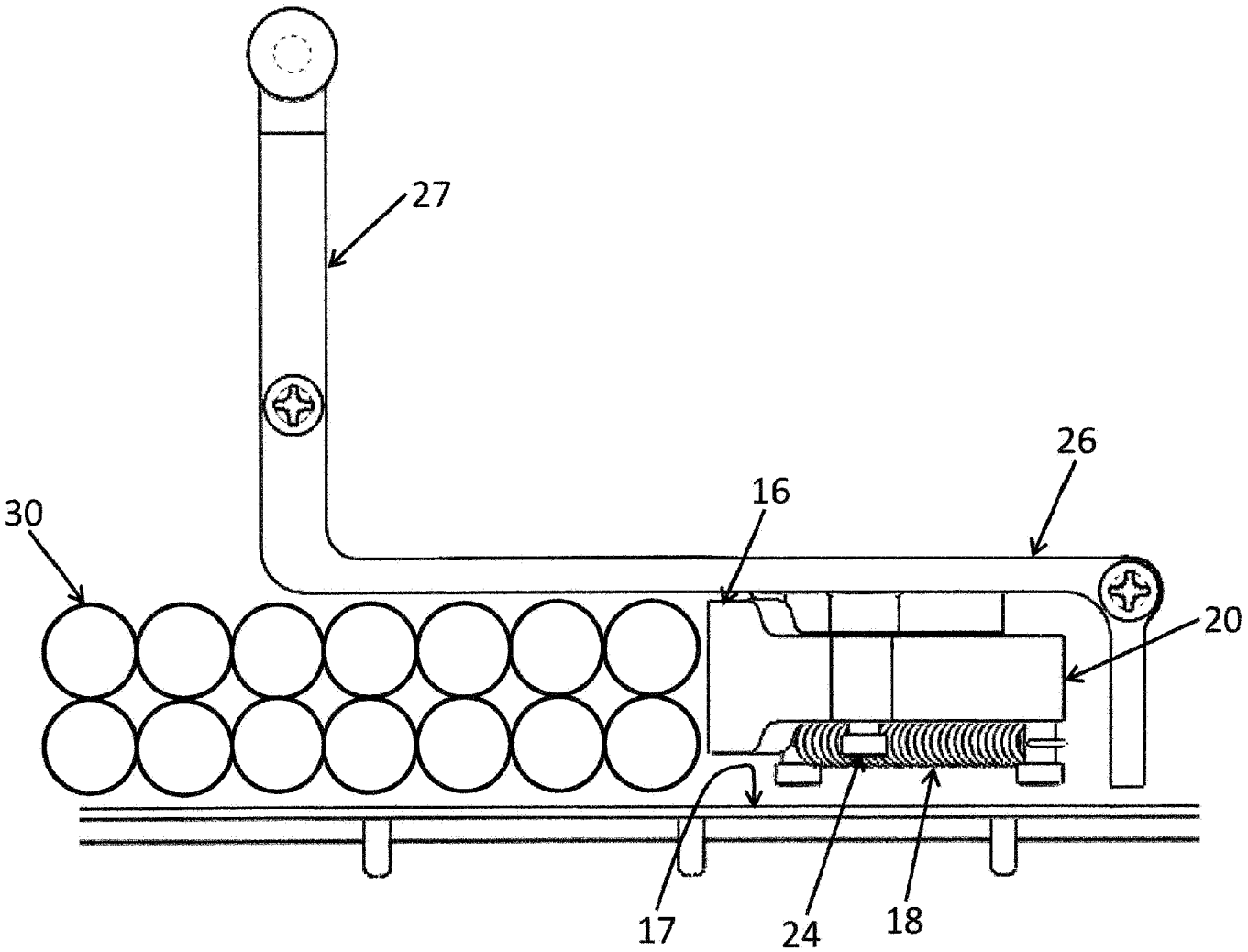
FIG. 5 illustrates the flapper in the retracted position as shown in FIG. 4.

FIG. 5 illustrates the flapper 16 in the retracted position as shown in FIG. 4.

Figure 6:
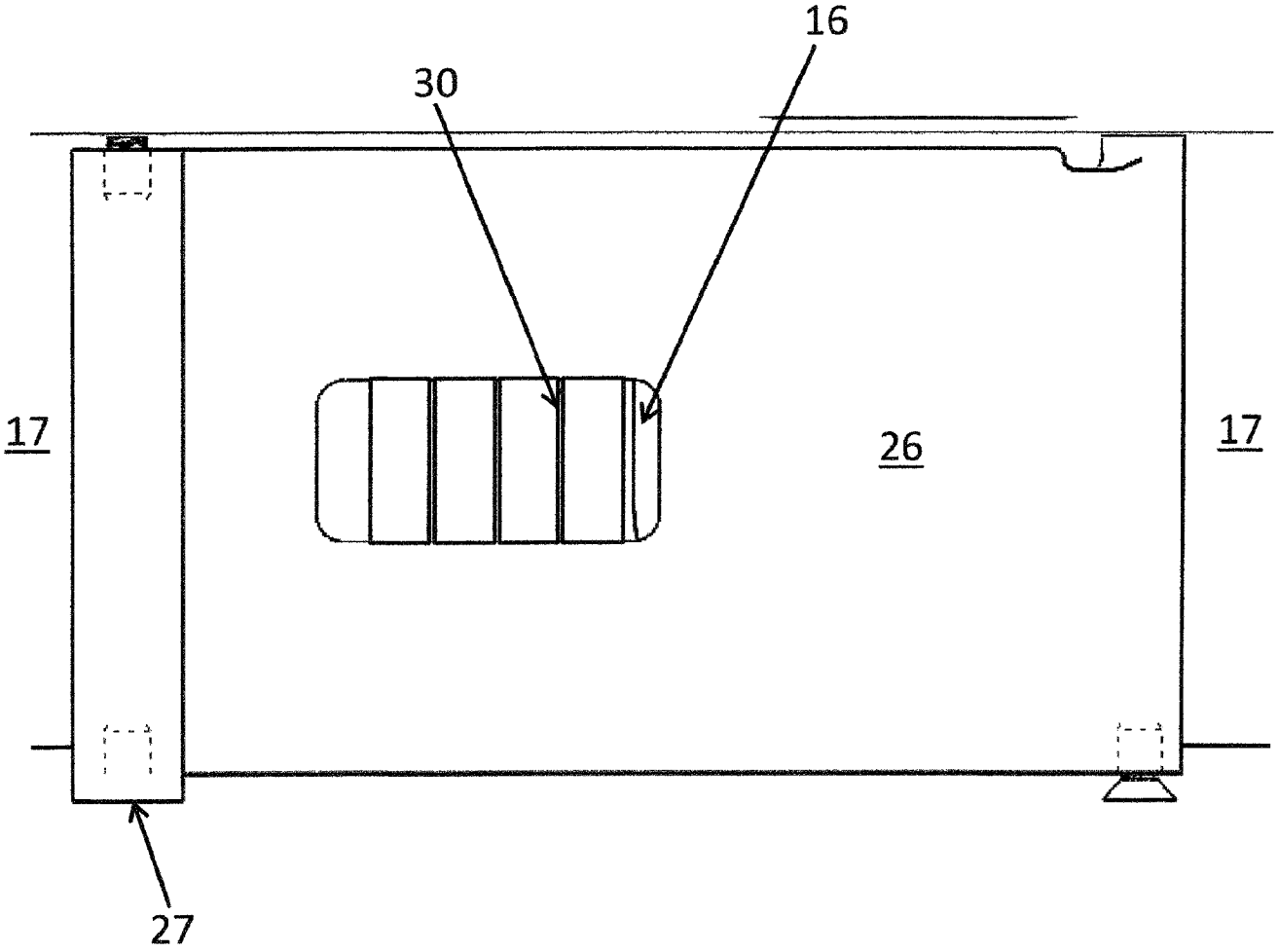
FIG. 6 illustrates a slot in a ledge allowing a loader to see from above that the flapper is compressed and there is ammunition visible under the ledge, indicating the supply of ammunition is greater than the predetermined quantity.

FIG. 6 illustrates the slot 28 allowing a user to see that the flapper 16 is compressed and there is ammunition 30 visible under the ledge 26.

The foregoing detailed description is to be clearly understood as being given by way of illustration and example only, the spirit and scope of the present invention being limited solely by the appended claims.

What is claimed is:

1. An ammunition magazine, comprising:

a container configured to hold ammunition and dispense the ammunition to a weapon; and an indicator disposed in the container and configured to create a signal indicative of a predetermined amount of ammunition remains in the container, wherein the indicator comprises:

a sensor member configured to engage with the ammunition when more than the predetermined amount of ammunition remains in the container, and configured to not engage with the ammunition when less than the predetermined amount of ammunition remains in the container, wherein the sensor member is comprised of a lever that is configured to have a first position when the container holds at least the predetermined amount of ammunition, and a second position when the container holds less than the predetermined amount of ammunition;

a signal generator coupled to the sensor member and configured to provide an electrical signal indicative of whether the sensor member is engaging the ammunition, or is not engaging the ammunition; and a ledge member disposed over the lever and having a pivot coupled to the lever.

2. The ammunition magazine as specified in claim 1, wherein the lever engages the ammunition in the first position, and does not engage the ammunition in the second position.

3. The ammunition magazine as specified in claim 2 wherein the lever is configured to automatically transition from the first position to the second position when the ammunition stops engaging the lever.

4. The ammunition magazine as specified in claim 2, wherein the lever is positioned on a bottom of the container.

5. The ammunition magazine as specified in claim 4, wherein the sensor member is positioned at a central position on the bottom of the container.

6. The ammunition magazine as specified in claim 4, wherein the predetermined amount is a function of where the sensor member is positioned on the bottom of the container.

7. The ammunition magazine as specified in claim 1, wherein the signal generator comprises a switch.

8. The ammunition magazine as specified in claim 1, further comprising a spring configured to urge the lever to the second position.

9. The ammunition magazine as specified in claim 8, wherein the spring extends between one end of the lever and the ledge member.

10. The ammunition magazine as specified in claim 1, wherein the ledge member is configured to be disposed over a portion of the ammunition proximate the sensor member.

11. The ammunition magazine as specified in claim 10, wherein the portion of the ammunition proximate the sensor member is disposed between the ledge member and a bottom of the container.

12. The ammunition magazine as specified in claim 11, wherein the lever is configured to move between the first position and the second position in a direction parallel to the bottom of the container.

13. The ammunition magazine as specified in claim 10, wherein the ledge member is configured to wedge the portion of the ammunition in place.

14. The ammunition magazine as specified in claim 13, further comprising a vertical member configured to allow the ammunition to be draped over the vertical member and then wedged under the ledge member.

15. The ammunition as specified in claim 14, wherein the ledge member includes the vertical member.

16. The ammunition magazine as specified in claim 1, wherein the ledge member comprises a plate.

17. The ammunition magazine as specified in claim 16, wherein the ledge member is parallel to a bottom of the container.

18. The ammunition magazine as specified in claim 1, further comprising an opening in the ledge member configured to allow a user to see a bottom of the container from above the container when the lever is in the second position.

19. An ammunition magazine, comprising:

a container configured to hold ammunition and dispense the ammunition to a weapon and having a bottom; and an indicator disposed in the container and configured to create a signal indicative of a predetermined amount of ammunition remains in the container, wherein the indicator comprises:

a lever configured to engage with the ammunition when more than the predetermined amount of ammunition remains in the container, and configured to not engage with the ammunition when less than the predetermined amount of ammunition remains in the container, wherein the lever is configured to pivot about an axis that is perpendicular to the bottom of the container to have a first position when the container holds at least the predetermined amount of ammunition, and a second position when the container holds less than the predetermined amount of ammunition;

a signal generator coupled to the lever and configured to provide an electrical signal indicative of whether the lever is engaging the ammunition, or is not engaging the ammunition; and a ledge disposed inside the container at a position over the lever and configured to secure the ammunition in engagement with the lever when more than the predetermined amount of ammunition remains in the container.

* * * * *